United States Patent [19]

Ronchi et al.

[11] Patent Number: 4,485,751

[45] Date of Patent: Dec. 4, 1984

[54] METHOD AND APPARATUS FOR SEAMING OPPOSED GARMENT EDGES SIMULTANEOUSLY

[75] Inventors: Adelio Ronchi; Roberto Sanvito, both of Milan, Italy

[73] Assignee: Rockwell-Rimoldi S.p.A., Italy

[21] Appl. No.: 456,133

[22] Filed: Jan. 6, 1983

[30] Foreign Application Priority Data

Jan. 19, 1982 [IT] Italy ..... 19177 A/82

[51] Int. Cl.[3] ..... D05B 1/08

[52] U.S. Cl. ..... 112/163

[58] Field of Search ..... 112/163-167, 112/155, 260, 262.1, 136, 262.2, 152, 153

[56] References Cited

U.S. PATENT DOCUMENTS

| | | | |
|---|---|---|---|
| 112,189 | 2/1871 | Smith | 112/163 X |
| 874,728 | 12/1907 | Bishop | 112/260 |
| 1,860,870 | 5/1932 | Ollendorf | 112/164 |
| 3,628,479 | 12/1971 | Schafer | 112/167 |
| 4,063,524 | 12/1977 | Ochiai | 112/163 X |
| 4,395,960 | 8/1983 | Jung | 112/163 |

FOREIGN PATENT DOCUMENTS

| | | | |
|---|---|---|---|
| 348659 | 10/1970 | U.S.S.R. | 112/163 |

*Primary Examiner*—Henry S. Jaudon
*Assistant Examiner*—Andrew M. Falik

[57] ABSTRACT

A method and machine for simultaneously forming seams along opposite sides of a garment workpiece in which the edges being sewn are gradually aligned so as to follow rectilinear paths that coincide with the machine's lines of sewing. The excess material of the garment disposed between the opposite sides being sewn is gathered and caused to pass through the area intermediate the lines of sewing. The sewing machine adapted to perform this function is provided with a pair of spaced needle bars that define the machine's lines of sewing and the space between these lines is clear of any interfering elements thus providing an area for the material intermediate the opposite sides to pass which has a width greater than the distance between the lines of sewing.

4 Claims, 4 Drawing Figures

METHOD AND APPARATUS FOR SEAMING OPPOSED GARMENT EDGES SIMULTANEOUSLY

BACKGROUND OF THE INVENTION

The present invention pertains to a method and machine for simultaneously forming seams of stitches on opposing edges or sides of garment workpieces in which said edges are not necessarily parallel.

Machines are well known to those conversant in the art which are capable of forming a seam along an edge of a fabric workpiece of irregular configuration. Such seams are accomplished either manually or by causing the edge being sewn to follow a suitable guide surface disposed in close proximity with the machine's needle. With machines of this type, it is necessary with workpieces having opposed edges to first sew one edge and then the other. For a more detailed description of this type of sewing machine attention is hereby directed to U.S. Pat. No. 3,377,967.

The types of garments formed by the workpieces described supra may be singlets or T-shirts and the terms opposing edges or sides should be understood to mean the two circular openings for the arms which are identical to one another, or the rear neckline and the forward neckline in which the latter is of greater length than said rear neckline.

In the known method of sewing or forming a hem on these circular openings, two separate operations are performed with a sewing machine which is considered to involve an excessive amount of time to accomplish the required amount of seaming, and also seams are never formed precisely the same for they are sewn at different times and the thread tensions under which they are sewn are not always consistant.

To reduce the amount of time to form two separate seams on the edges of a workpiece, the present invention provides a means whereby such seams can be formed simultaneously and will possess identical characteristics.

SUMMARY OF THE INVENTION

With this method of simultaneously sewing the opposed edges of a garment workpiece, it is possible to gradually direct the edges as they are being sewn to follow rectilinear paths which coincide with the lines of sewing and the excess material of the workpiece between the opposed edges is gathered together and caused to pass unrestricted in the area intermediate said lines of sewing. A characteristic of this method is that of causing the garment to be opened out in a manner whereby the superposed portions that correspond to each edge lie at opposing sides, in the same plane, and the edges opened in this manner are gradually manipulated so as to follow rectilinear paths which coincide with lines of sewing and between said lines the excess material of the garment is gathered and caused to advance unrestricted therebetween.

The sewing machine for accomplishing this method is provided with two spaced apart needle bars adapted to simultaneously sew along opposite edges of a garment workpiece utilizing the above described method. Intermediate the machine's needles and needle bars which define the lines of sewing, an unrestricted space is provided which is adapted to receive the excess material of the garment as its edges are being sewn. The edges of the garment are guided in accordance with the lines of sewing which are spaced by a distance that is less than that separating said edges.

A further characteristic of the invention is that of providing two guides disposed in close proximity with the needles and tangential to the lines of sewing. These guides are effective in engaging the opposed edges of the workpiece as said edges are advanced in the direction of the stitching zone.

These and other characteristics of the invention will become more fully apparent by reference to the appended claims and as the following detailed description proceeds in reference to the figures of drawing wherein:

DESCRIPTION OF THE PREFERRED EMBODIMENT

Figure 1:
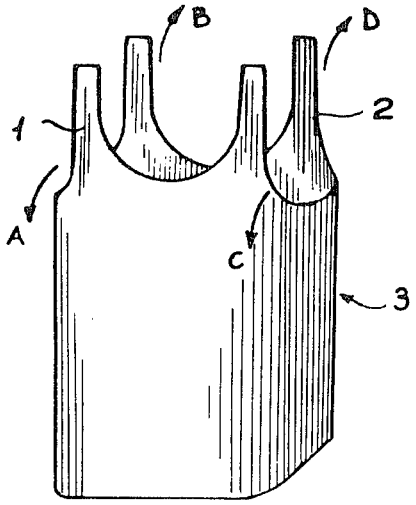
FIG. 1 is a perspective view of a singlet or T-shirt type garment having opposed edges for seaming by the method and apparatus of the inventions.
Figure 2:
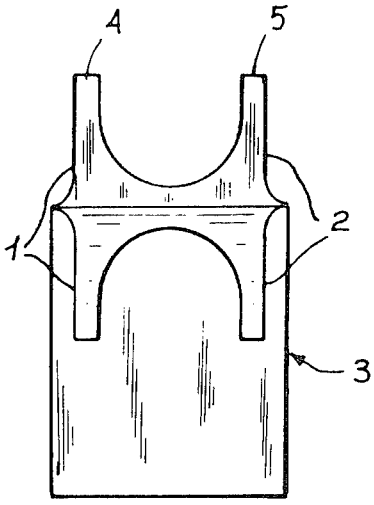
FIG. 2 is an elevational view of the garment in FIG. 1 opened out in preparation for seaming.

In FIGS. 1 and 2 a garment workpiece, of the singlet or T-shirt type, is shown and indicated generally by numeral 3. This garment workpiece, hereinafter referred to as garment, includes opposed edges or sides identified by numerals 1 and 2, and to prepare said garment for seaming, it is opened out in the sense of arrows A, B, C and D in FIG. 1 so as to arrange it as shown in FIG. 2.

To commence seaming, the shoulder straps 4 and 5 are placed beneath the presser feet 6 and 7 (FIG. 3) and the machine's needles depicted by numerals 8 and 9 that are carried by needle bars 8' and 9' respectively cause said needles to perform their intended functions by passing through said presser feet to cooperate with well known looper elements not shown. These needles and their respective loopers cooperate to form the lines of stitching along identical opposed edges 1 and 2 of the garment. The manner of driving and the cooperation between the needles and loopers can be obtained by refering to U.S. Pat. No. 3,628,479.

The location of the lines of stitching are controlled by the operator guiding one edge of the garment with one hand and the other edge with the other hand and manipulating the edges so that they are caused to follow a linear path of travel. This is effective in causing the excess material, of the garment disposed between its opposed edges, to be gathered and to be advanced unrestricted in the area intermediate the needle bars 8' and 9'. This area within which the excess material is gathered and advanced during seaming is identified by numeral 10 and permits said, material to extend upwardly in this area or else downwardly between spaced side walls 11 of a channel formed in the base of the sewing machine 12.

Figure 4:
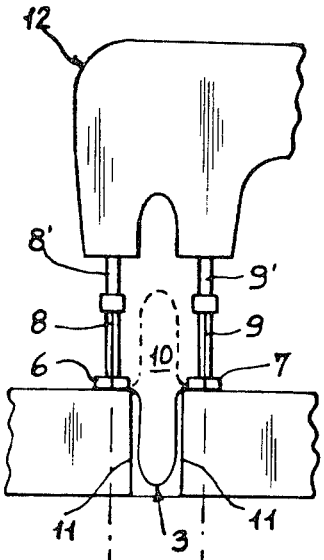
FIG. 4 is a view in side elevation of a portion of the sewing machine for simultaneously forming seams along opposite sides of a garment workpiece.

As shown in FIG. 4, the excess material of the garment 3 is shown as a dotted line, when it extends upwardly between the needle bars 8' and 9' and is shown as a solid line when extending downwardly into the channel having spaced side walls 11.

Figure 3:
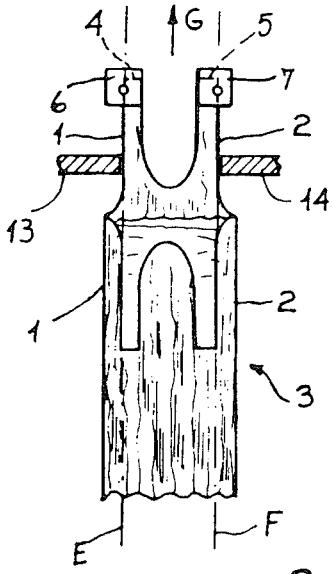
FIG. 3 is a plan view of the garment during the seaming operation.

By using both hands, the operator introduces tension that is effective in causing the curved edges 1 and 2 to become deformed to the extent whereby they are caused to follow rectilinear paths which coincide with lines E and F of sewing as is shown in FIG. 3.

When relatively stiff materials are to be sewn, two guide members 13 and 14. are utilized that are positioned in close proximity with the needles 8 and 9 and tangential to the lines E and F of sewing and are effective in guiding edges 1 and 2 by causing them to bear against said guide members 13 and 14. which causes said edges to follow rectilinear paths that coincide with said lines E and F of sewing.

Suitably oriented jets of air are directed against the excess material between edges 1 and 2 of the garment which assist in the advancement of the garment as well as urging said excess material either upwardly between needle bars 8' and 9' or downwardly into the channel formed by the spaced side walls 11.

If necessary an auxiliary transport means may be utilized downstream of the needles for cooperating with the machines conventional feed dogs (not shown) for advancing the garment in the direction of arrow G (FIG. 3) as the opposed edges or sides gradually become sewn.

A characteristic and essential condition required to perform the above-described method is that the distance between the opposing sides or edges to be sewn must be greater than that existing between the lines of sewing. Consequently, in order to sew garments which are not very wide, it is necessary that the needle bars be located close to each other and that an unrestricted area be provided for receiving the excess material located intermediate the opposing sides or edges. The method described supra for seaming the opposed sides of garment workpieces such as singlets or T-shirts can also be utilized on other workpieces having opposed edges such as towels, handkerchiefs and sheets which have rectilinear opposed edges.

It has been indicated generally that the opposed edges are sewn; however, it should be understood that such stitching may accommodate a variety of particular requirements for a particular workpiece such as conventional hemming with or without elastic as well as a hem with frills, tapes and lace. Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended Claims.

We claim:

1. In a sewing machine having a base and a pair of spaced needle bars and a needle mounted in each needle bar in operative association with a presser foot associated with each needle, the method of simultaneously forming seams along opposed edges of a garment workpiece having greater width than the distance between the spaced needle bars which comprises the steps of:

(a) inserting the opposed edges beneath the presser foot associated with each needle;

(b) guiding the opposed edges so that they follow rectilinear paths during seaming;

(c) gathering the excess material disposed intermediate the opposed edges in a channel in the base area between the spaced needle bars; and (d) guiding the excess material in said area between the needle bars as it is advanced through the sewing zone.

2. The method according to claim 1 which includes the step of opening the garment workpiece prior to seaming whereby the superposed portions that correspond to each edge are disposed at opposing sides and in the same plane.

3. A seaming apparatus for sewing machines of the type for simultaneously forming seams along opposed sides of a garment workpiece having greater width than the distance between the seams being formed, said seaming apparatus comprising;

(a) a supporting frame having a base;

(b) a pair of spaced needle bars mounted for reciprocating movement in said supporting frame;

(c) a needle attached to each needle bar defining lines of sewing;

(d) means intermediate said needle bars for receiving and guiding the excess material disposed between the opposed sides during the seaming operation; said means for receiving and guides including spaced side walls defining a channel formed in said base within which the excess material is guided and advanced; and (e) means mounted adjacent each said needle for engaging the opposed sides to effect their travel in rectilinear paths that coincide with the lines of sewing.

4. The seaming apparatus according to claim 3 wherein said engaging means defines a pair of opposed workpiece guides.

* * * * *